US005080317A

United States Patent [19]

Letizia

[11] Patent Number: 5,080,317

[45] Date of Patent: Jan. 14, 1992

[54] PICTURE ANCHORING ASSEMBLY

[76] Inventor: Louis S. Letizia, 3220 N. Blue Ridge Ct., Westlake Village, Calif. 91362

[21] Appl. No.: 628,466

[22] Filed: Dec. 17, 1990

[51] Int. Cl.[5] ..... F16M 13/00

[52] U.S. Cl. ..... 248/544; 33/613; 248/466

[58] Field of Search ..... 248/544, 547, 466, 475.1, 248/476, 489, 216.1, 217.2, 217.3; 206/542, 231; 33/613, 679

[56] References Cited

U.S. PATENT DOCUMENTS

| | | | |
|---|---|---|---|
| 4,085,917 | 4/1978 | Brantley, Jr. | 248/489 |
| 4,094,490 | 6/1978 | Einhorn | 248/489 |
| 4,169,308 | 10/1979 | Minogue | 248/489 X |
| 4,241,510 | 12/1980 | Radecki | 33/613 |
| 4,443,949 | 4/1984 | Newton | 33/613 |
| 4,455,756 | 6/1984 | Greene | 33/613 |
| 4,557,457 | 12/1985 | Cockfield et al. | 248/544 |
| 4,610,419 | 9/1986 | Swanson | 248/547 |
| 4,804,161 | 2/1989 | Wallo | 248/489 X |

*Primary Examiner*—Ramon O. Ramirez
*Attorney, Agent, or Firm*—Jack C. Munro

[57] ABSTRACT

A picture anchoring assembly for fixedly positioning a framed picture on a vertical wall surface. The anchoring assembly includes an elongated body one end of which is to be connectable to a pointed end of a fastener. The fastener also has an opposite end which is pointed. The elongated body is to be manually used by the user to cause this opposite end to be penetrated within the frame of the picture. The body is then removed from the fastener with the now unattached end of the fastener to be utilized to penetrate the vertical wall surface. The body will also include a level vial so that when the body is placed on the upper edge of the picture frame the user is capable of ascertaining a precise horizontal position for the upper edge of the picture frame.

8 Claims, 1 Drawing Sheet

FIG. 1
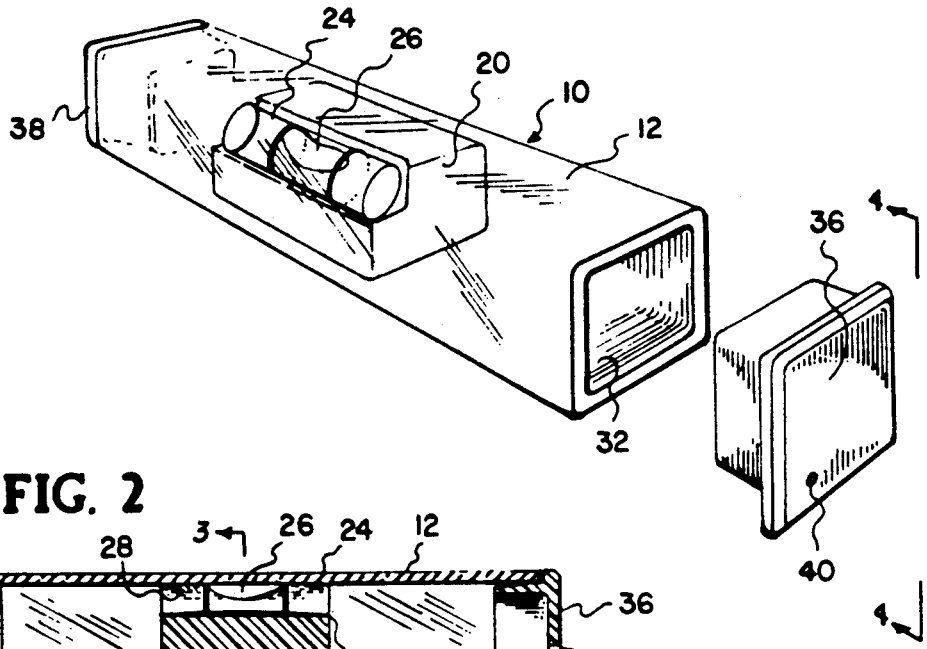
FIG. 2
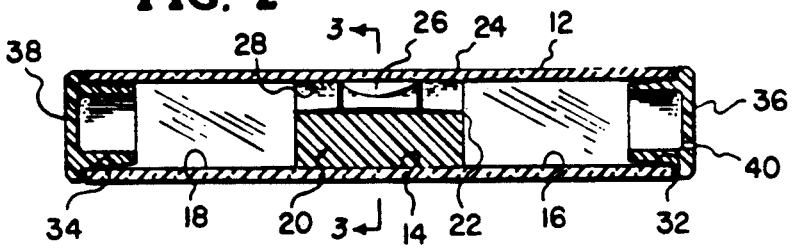
FIG. 4
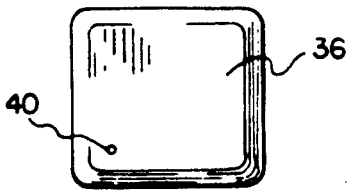
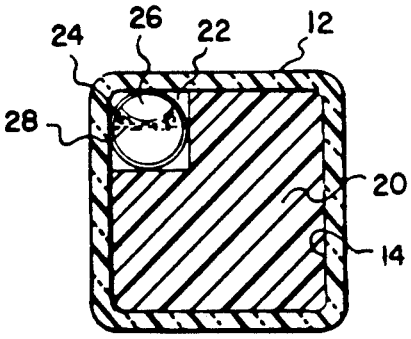
FIG. 3
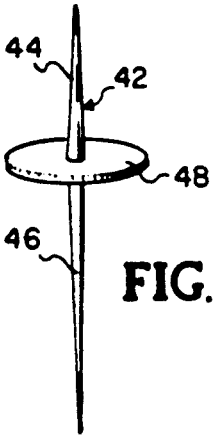
FIG. 5

PICTURE ANCHORING ASSEMBLY

BACKGROUND OF THE INVENTION

The field of this invention relates to an anchoring assembly for framed pictures and more particularly to an anchoring assembly which can be utilized so that the framed picture can be mounted on a vertical wall surface so that the upper edge of the picture is horizontal and the resulting picture will remain in that position and not be skewed.

In the hanging of pictures on walls, it is common to hang pictures by a hook or nail with a small fastener, wire or cord being mounted on the frame of the picture. The fastener, wire or cord is to be supported on the nail or hook which is mounted within the wall.

Most pictures are mounted within frames. The common most frame is generally rectangular. It is generally desired to have the upper edge of the frame be located precisely horizontal. Invariably, the horizontal positioning of the framed picture shifts to a slightly skewed position. This skewing of the framed picture may be due by virbration or settling of the house or building, by rapid circulation of air within a room, by means of misaligning of the framed picture during cleaning, by earthquake or for numerous other reasons.

The constant realigning of pictures within a house or building is certainly annoying. In the past, there have been attempts for designing devices to eliminate framed picture misalignment. One such device is shown within U.S. Pat. No. 417,805 to a Mr. Beaman issued Dec. 24, 1889. The Beaman invention has to do with a fastener that is pointed on opposite ends with one end of the pointed fastener to be embedded within the picture frame and the opposite end of the pointed fastener to be embedded within the wall. This embedding of the fastener is to be at the lower inside edge of the picture frame. Therefore, with the picture frame being supported by its hanging device on the upper edge and now the lower edge of the frame held in a fixed position, skewing of the picture does not occur.

In the past, there have been designed assemblies with kits for hanging of pictures and typical such assemblies are shown within the U.S. Pat. Nos. 4,241,510; 4,443,949; and 4,455,756. Although there are assemblies for the hanging of pictures, there is not been known to Applicant any such assembly to facilitate the utilizing of a device to keep the picture straight when the framed picture is mounted on a wall.

SUMMARY OF THE INVENTION

The principal objective of this invention is to construct an assembly which can be used to attach a device to the frame of a picture so that when the framed picture is mounted on a wall, it is maintained in the mounted position on that wall preventing skewing of the framed picture as times goes on.

Another objective of this invention is to construct a picture anchoring assembly which is simple to utilize thereby not requiring a great degree of skill by the user.

Another objective of this invention is to construct a picture anchoring assembly which can be manufactured at a relatively inexpensive price and thereby sold to the ultimate consumer at an inexpensive price.

The picture anchoring assembly of this invention is designed to be utilized in conjunction with a fastener which has opposite pointed ends. One pointed end of the fastener is to be mounted within a hole mounted within an end cap of an elongated tubular body which is to be grasped and used by the user to cause penetration of the fastener into the picture frame. The body includes a level vial so that the body can then be placed on the upper edge of the picture frame then by slightly pivoting the picture frame the user can observe at what point the upper surface of the picture frame is horizontal and at that time the fastener is caused to penetrate the wall surface thereby the framed picture will be maintained in that position and skewing of the picture will be prevented. The elongated body is to include storage compartments for picture hanging hooks and for the fasteners that are utilized to penetrate the frame and the wall.

BRIEF DESCRIPTION OF THE DRAWING

FIG. 1 is a perspective view of the picture anchoring assembly of this invention showing an end cap of the body of the picture anchoring assembly being removed;

FIG. 2 is a longitudinal cross-sectional view through the elongated body of the picture anchoring assembly of this invention;

FIG. 3 is as transverse cross-sectional view through the elongated body of the picture anchoring assembly of this invention taken along line 3—3 of of FIG. 2;

FIG. 4 is an end view of the elongated body of the picture anchoring assembly of this invention showing clearly the exterior surface of one of the end caps; and FIG. 5 is a perspective view of the double pointed fastener that is utilized in conjunction with the picture anchoring assembly of this invention.

DETAILED DESCRIPTION OF THE SHOWN EMBODIMENT

Referring particularly to the drawing, there is shown the picture anchoring assembly 10 of this invention. The assembly 10 is composed primarily of an elongated body 12 which is shown to be of a square polygonal configuration in transverse cross-section. Elongated body 12 is hollow forming a center interior chamber 14. On one side of interior chamber 14 is an interior compartment 16. On the opposite side of interior chamber 14 is another interior compartment 18. Securely mounted within interior compartment 14 is a block 20. Block 20 will be of a rigid material such as plastic.

Block 20 includes a cutout area 22. Located within this cutout area 22 is a transparent plastic or glass vial 24. The surface of the vial 24 that is located nearest an interior wall surface of the chamber 14 is formed slightly arcuate. Within the vial 24 is located a liquid 28 and an air bubble 26. Vial 24 is fixedly mounted to the block 20. The position of the air bubble 26 is readily visually observable since the wall of the elongated body 12 is transparent. The air bubble 26 will be centrally disposed within the vial 24 when the body 12 is oriented in a precisely horizontal position.

Access into the chamber 16 is provided by access opening 32. Access into the chamber 18 is provided by access opening 34. The access opening 32 is normally closed by means of a plastic end cap 36. The access opening 34 is normally closed by means of plastic end cap 38. Each of the end caps 36 and 38 are to be easily, manually removable to gain access into their respective chamber 16 or 18. Within chambers 16 and 18 there may be stored picture hanging articles such as hooks and fasteners such as shown within FIG. 5. Typical length of the fastener shown in FIG. 5 will be approximately one and one-quarter inches.

The end caps 36 and 38 are identical with the exception of end cap 36 including a hole 40. Hole 40 constitutes a through opening entirely through the wall surface of the end cap 36. It is to be noted that the hole 40 is not centrally located within end cap 36 and is actually located near one of the corners of the end cap 36. The reason for the hole 40 and the reason so locating of the hole 40 will be explained further on in this specification.

Associated with the picture anchoring assembly 10 of this invention will be a plurality of fasteners 42 such as shown in FIG. 5. Each fastener 42 has a short pointed end 44 and a longer pointed end 46. Pointed ends 44 and 46 are separated by a disc shaped or annular separating flange 48.

Usage of the picture anchoring assembly 10 of this invention is as follows: A plurality of fasteners 42 will be stored within interior compartment 16. When it is desired to use the assembly 10, the user removes end cap 36 and removes one of the fasteners 42. The user then replaces end cap 36 within the access opening 32 in a tight fitting manner. The user then inserts short pointed end 44 through hole 40 until flange 48 abuts against exterior surface of the end cap 36. The user then grasps the exterior surface of the body 12 and manually forces the longer pointed end 46 to penetrate the lower interior edge of a picture frame (not shown). This penetration is to occur until the separating flange 48 abuts against the surface of the picture frame. At this time, the user then removes the body 12 which leaves the short pointed end 44 exposed.

The user then is to place the body 12 on the top edge of the picture frame so that the vial 24 can be readily observed. The user then adjusts the position of the picture on the wall until the air bubble 26 is centrally disposed within the vial 24. At this particular time, the user then presses the picture frame toward the wall which results in the short pointed end 44 penetrating slightly the wall surface. The result is the picture frame is now fixed in its established position and misalignment of the picture frame due to small earthquakes, air currents, vibrations and the like will not occur.

What is claimed is:

1. A picture anchoring assembly for fixedly positioning a framed picture on a vertical wall surface comprising:

a fastener having a pair of opposite pointed ends defined as a first pointed end and a second pointed end, said first pointed end for penetrating the frame of a picture, said second pointed end for penetrating the vertical wall surface; and an elongated body adapted to be conveniently grasped by a human being user, said body being substantially hollow having open ends each of which is normally closed by an end cap, one said end of said cap includes a hole, said second pointed end of said fastener is to be located in said hole with said elongated body grasped and used as a tool for penetrating the picture frame by said first pointed end of said fastener that is free of said hole.

2. The picture anchoring assembly as defined in claim 1 wherein:

said fastener including a separating annular flange, said separating annular flange being located intermediate said first and second pointed ends.

3. The picture anchoring assembly as defined in claim 1 wherein:

said elongated body being polygonal in cross-sectional configuration to thereby facilitate resting on a planar surface, said body being adapted to be located in a resting position on the upper edge of a picture frame, a level vial located within said hollow of said elongated body, said level vial being observable to ascertain whether the top edge of the picture frame is horizontal.

4. The picture anchoring assembly as defined in claim 1 wherein:

said hole being non-centered and located near the peripheral edge of said one of said end caps.

5. The picture anchoring assembly as defined in claim 1 wherein:

said hollow of said elongated body having a pair of storage compartments, one of said end caps providing access into one of said storage compartments with the other of said end caps providing access into the other of said storage compartments, each said storage compartment is to be utilized to contain picture anchoring equipment such as said fasteners.

6. The picture anchoring assembly as defined in claim 5 herein:

said fastener including a separating annular flange, said separating annular flange separating said first and second pointed ends.

7. The picture anchoring assembly as defined in claim 6 wherein:

said elongated body being polygonal in cross-sectional configuration to thereby facilitate resting on a planar surface, said body being adapted to be located in a resting position on the upper edge of a picture frame, a level vial located within said hollow of said elongated body, said level vial being observable to ascertain whether the top edge of the picture frame is horizontal.

8. The picture anchoring assembly as defined in claim 7 wherein:

said hole being non-centered and located near the peripheral edge of said one of said end caps.

* * * * *